US009631396B2

(12) United States Patent
Leach

(10) Patent No.: US 9,631,396 B2
(45) Date of Patent: Apr. 25, 2017

(54) DO-IT-YOURSELF FENCE

(76) Inventor: Eddie Leach, Lake Tapps, WA (US)

( * ) Notice: Subject to any disclaimer, the term of this patent is extended or adjusted under 35 U.S.C. 154(b) by 557 days.

(21) Appl. No.: 13/527,130

(22) Filed: Jun. 19, 2012

(65) Prior Publication Data

US 2013/0153843 A1 Jun. 20, 2013

Related U.S. Application Data

(60) Provisional application No. 61/498,909, filed on Jun. 20, 2011.

(51) Int. Cl.

| | |
|---|---|
| ***E04H 17/02*** | (2006.01) |
| ***B21F 27/00*** | (2006.01) |
| ***E04H 17/16*** | (2006.01) |
| ***E04H 17/14*** | (2006.01) |

(52) U.S. Cl.

CPC ..... *E04H 17/16* (2013.01); *E04H 17/143* (2013.01); *E04H 17/02* (2013.01)

(58) Field of Classification Search

CPC ..... E04H 17/16; E04H 17/143; E04H 17/02

USPC ... 256/59, 61, 62, 65.02, 65.08, 65.1, 65.12, 256/65.13, 65.14, 65.15, 68, 22, 65.01, 256/65.11

See application file for complete search history.

(56) References Cited

U.S. PATENT DOCUMENTS

| | | | | |
|---|---|---|---|---|
| 210,526 | A * | 12/1878 | Hanson | 256/67 |
| 4,149,352 | A * | 4/1979 | Allen | 52/476 |
| 4,625,948 | A * | 12/1986 | Lustvee | 256/72 |
| 4,898,365 | A * | 2/1990 | Conner et al. | 256/65.12 |
| 5,145,153 | A * | 9/1992 | Glynn | 256/59 |
| 5,415,380 | A * | 5/1995 | Sharp | 256/24 |
| 5,531,427 | A * | 7/1996 | Quarles | 256/22 |
| 5,695,174 | A * | 12/1997 | Tsai | 256/22 |
| 6,131,888 | A * | 10/2000 | Brown | 256/65.03 |
| 6,220,577 | B1 * | 4/2001 | Ostrow | 256/67 |
| 6,290,213 | B1 * | 9/2001 | Laird et al. | 256/65.05 |
| 6,540,209 | B2 * | 4/2003 | Ross | 256/68 |
| 6,648,304 | B1 * | 11/2003 | Zhu | 256/22 |
| 6,672,569 | B2 * | 1/2004 | Deeley | 256/22 |
| 6,679,482 | B2 * | 1/2004 | Allenbaugh | 256/65.14 |
| 7,503,550 | B2 * | 3/2009 | Liefke | 256/24 |
| 7,765,533 | B2 * | 7/2010 | Pessolano | 717/154 |
| 8,132,792 | B2 * | 3/2012 | Perris | 256/65.14 |
| 2003/0178614 | A1 * | 9/2003 | Venegas, Jr. | 256/65.1 |
| 2005/0006877 | A1 * | 1/2005 | Kachkovsky | 280/641 |
| 2009/0071919 | A1 * | 3/2009 | Blanchet et al. | 211/60.1 |
| 2009/0266833 | A1 * | 10/2009 | Savage et al. | 220/757 |
| 2010/0164191 | A1 * | 7/2010 | Kinnen | B62B 1/14 280/47.17 |
| 2011/0017968 | A1 * | 1/2011 | Christoffer et al. | 256/65.14 |

* cited by examiner

*Primary Examiner* — Michael P Ferguson
*Assistant Examiner* — Nahid Amiri

(57) ABSTRACT

A kit including a custom wheeled storage container packaging a free-standing fencing unit comprising a pair of interchangeable top and bottom rails connectors, a pair of end posts to interconnect with the top and bottom rails, a plurality of pickets with clips to attach to the top and bottom rails and a pair of free-standing fence stands.

5 Claims, 5 Drawing Sheets

DO-IT-YOURSELF FENCE

TECHNICAL FIELD

The current invention deals with fencing, and more particularly, with fencing that is constructed such that it can be stored and transported in a dismantled packaged condition, and when on site, can be quickly and easily snapped together without tools and erected to form a barrier. The fencing can be utilized in multiple sections, wherein each section is self-contained in a portable container.

BACKGROUND OF THE INVENTION

Fences have historically been used for multiple purposes, including keeping animals and/or people within a confined area, or in the alternative, keeping animals and/or people outside of an area. Historically, fences have tended to be permanent structures, but with the mobility of the current generation, the need has arisen for non-permanent fencing structures to temporarily define a space, whether that be for construction and/or entertainment. One of the problems encountered is that the current fencing on the market usually requires trucks and/or other heavy-duty equipment to transport the fence units from one location to another. The current fencing available also requires tools to assemble or disassemble.

Prior art known to the inventor pertinent to the present invention include:

U.S. Pat. No. 4,266,757 granted to Kirkwood on May 12, 1981, which discloses a corner fence clip, which in conjunction with a fence post, allows the random placement of rails, in that the attachment for the posts may be placed at any one of selected angles and the rails are snapped therein.

U.S. Pat. No. 4,951,925 granted Aug. 28, 1990 to Schultz et al, discloses a fence connector assembly wherein rail shapes are threaded into a post and the rails are then snapped into position over the post member.

U.S. Pat. No. 4,986,513 granted to Schultz et al Jan. 26, 1991, further including locking rails.

U.S. Publication US2010/004466 published Feb. 25, 2010 to Walmsley discloses a fence assembly, wherein the pales are snap-fit into the rails at predetermined locations.

U.S. Publication US2011/0017968 published Jan. 27, 2011 to Christoffer et al discloses a preassembled sectional safety rail for use in construction, wherein the rails are secured to a base plate by telescopically inserting vertical posts into the vertical ends of the rails.

U.S. Publication US2011/0073823 published Mar. 31, 2011 to Mitrovik, wherein the various elements are threadingly secured together to complete a fence structure.

U.S. Publication US2012/0061636 published Mar. 15, 2012 to Williams SR et al discloses a system for strengthening vinyl fences, wherein a kit is provided including U-shaped channel member which are inserted into the top and bottom sections of the preexisting railings.

SUMMARY OF THE INVENTION

With the above-noted history and the problems in mind, it is the desire of the current invention to provide lightweight, portable effective fencing, such that the user can quickly and easily transport the fencing units to the desired location and quickly erect a fencing structure of any desired length or configuration.

It is further a desire of the present invention to provide a novel fencing structure, such that the erection and/or dismantling of the fence can be completed without the use of tools.

Still another desirable aspect of the current invention is the fact that the fencing structure is very stable and solid in appearance, and yet is quickly and easily dismantled and transported to another location, whether for storage or use.

A further feature of the present invention is that each fencing unit is prepackaged and portable.

BEST MODE FOR CARRYING OUT THE INVENTION

Figure 1:
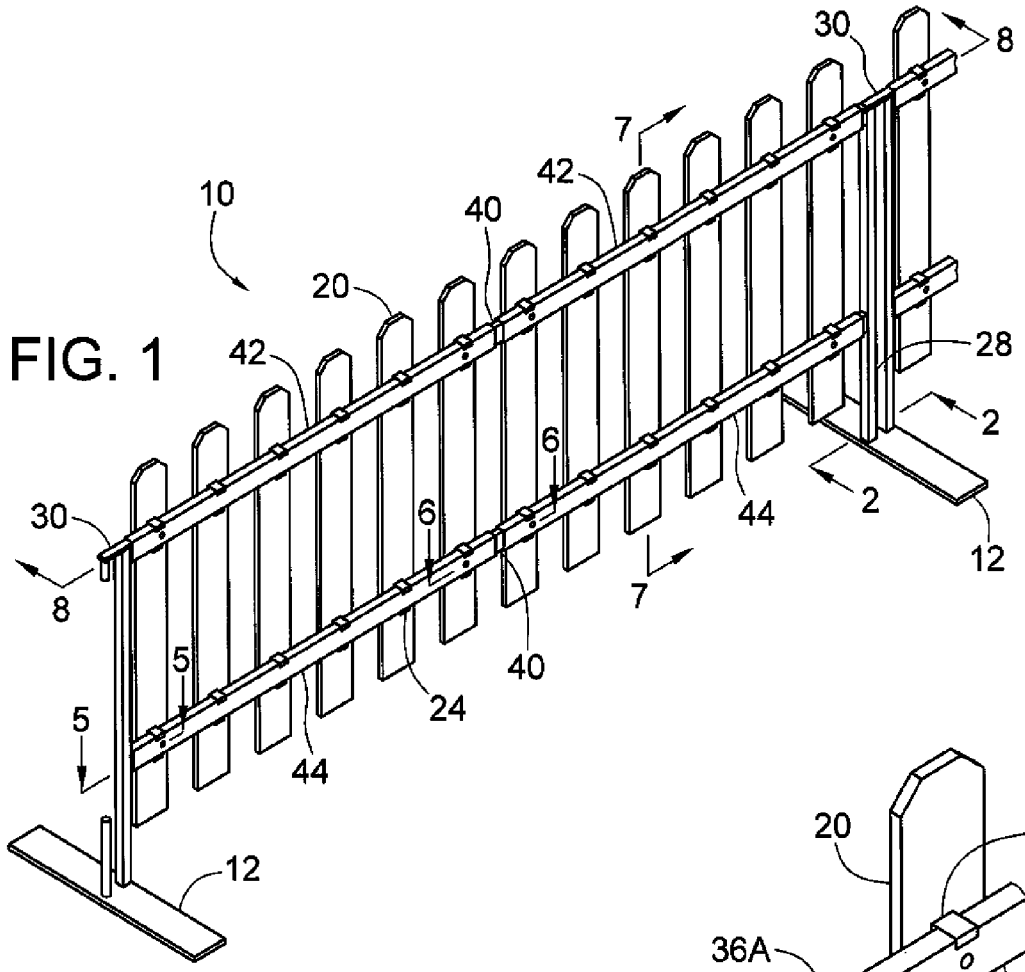
FIG. 1 is a perspective view of the assembled do-it-yourself fence according to the preferred embodiment of the present invention.
Figure 2:
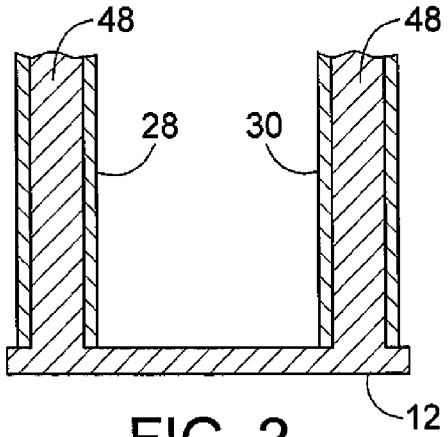
FIG. 2 is a sectional view of the fence taken along lines 2-2 of FIG. 1.
Figure 3:
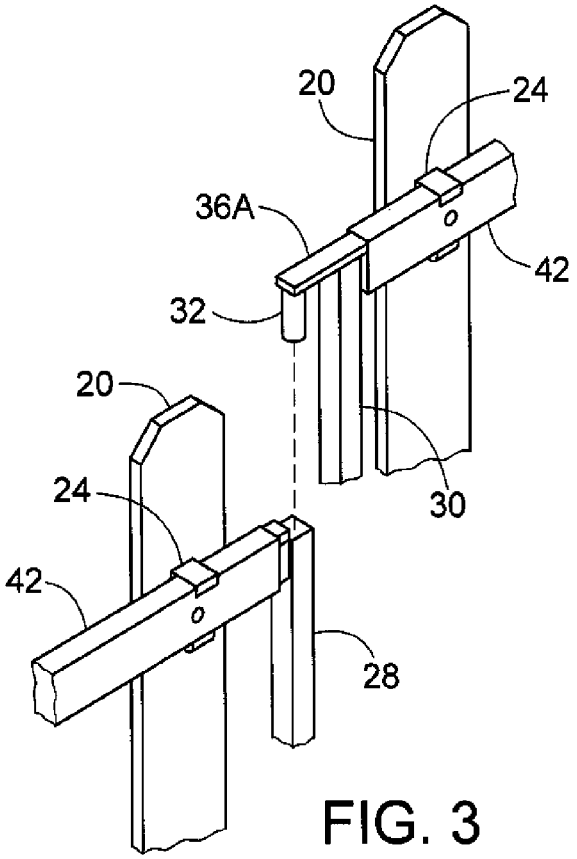
FIG. 3 is a detailed view of the intersection of two panels as shown in FIG. 1.

Referring now to the FIGS. 1-8, the isometric view of the fence kit 10 (FIG. 1) includes a left post 30 and a right post 28. For top and bottom rails 42, 44, two rail connectors 38, see FIG. 4, as well as two footings or stands 12-12, pickets 18 and tube clips 26.

The left post 30 has an F-shape in profile and includes a vertical member 34. The vertical member 34 may be a 3 ft long 1 inch×1 inch×0.65 inch rectangular steel tubing. A top horizontal member 38 and mid-height member 38 are welded to the right side of the first end of vertical member 34. The horizontal member 38 may be 8 inches long 1 inch×1 inch×0.165 inch rectangular steel tubing. The mid-height member 38 is located approximately 12 inches from the bottom end. A flat metal piece 36A is welded to the top side of horizontal member 38 in such a way that the metal piece 36A overhangs about 3-½ inches toward the vertical member 34. A frame connector pin or rail connector 32 is welded to the bottom side of the overhanging portion of metal piece 36A. The frame connector pin 32 may be a ¾-inch long stub made of ¾-inch hot rolled steel.

The right post 28 is a mirror image of the left post 30, with two exceptions, in that the flat metal piece 36 equivalent to the flat metal piece 36A has a length of only 8 inches and does not form an overhang such that two facing elements may be conveniently joined together, right to left.

A rail connector 40 (see FIG. 6) includes a horizontal member 38 and flat metal piece 36 welded to the top side of horizontal member 38. The flat metal piece may be an 8 inch×¼ inch×1 inch flat piece of metal. A ½ inch diameter hole 39 is drilled 4 inches from each end of the horizontal member 38. A tube clip 26 with a button pin 27 is disposed inside of each end of the horizontal member in a manner that allows the button pin 27 to pop out through the hole 39.

Figure 4:
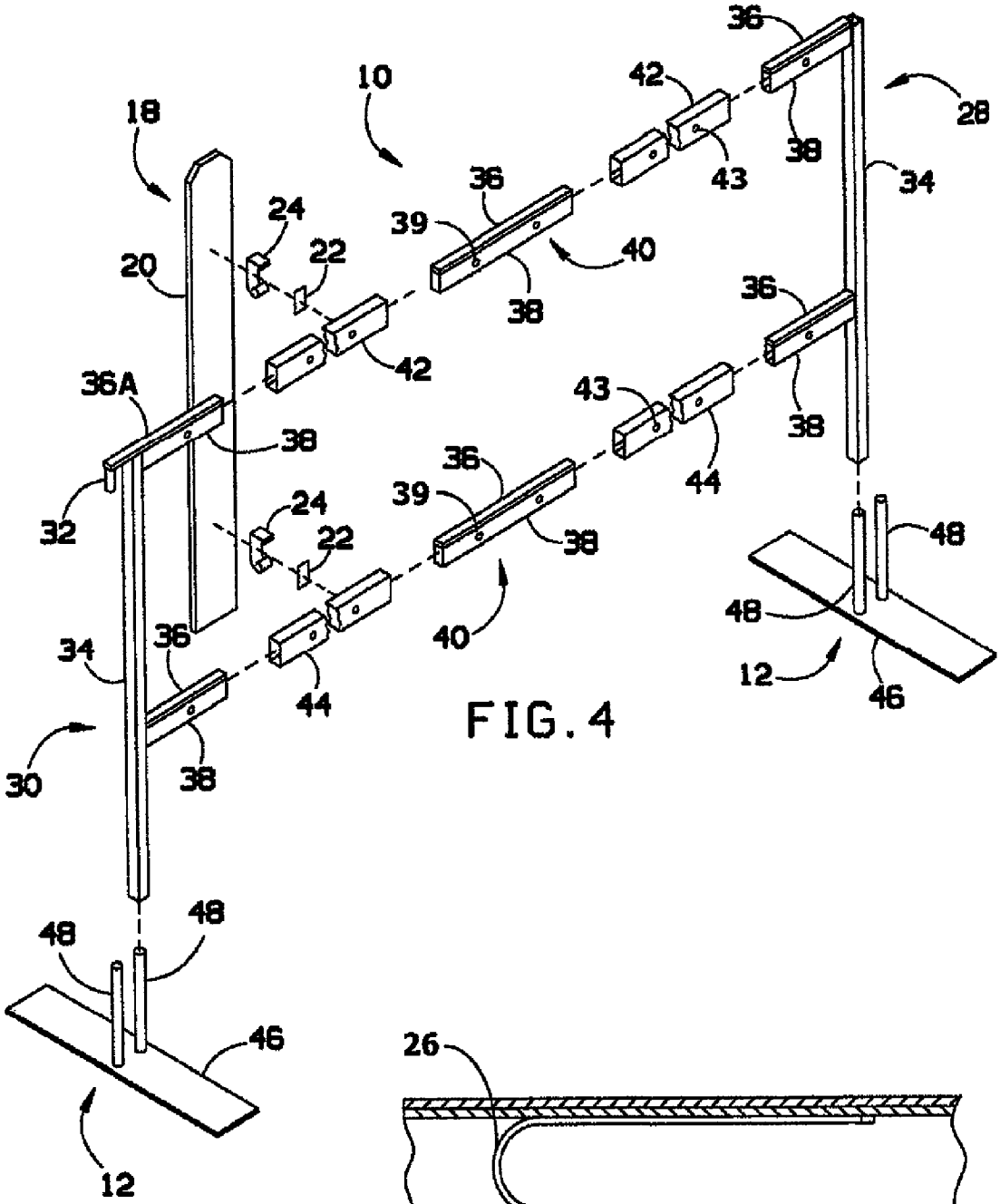
FIG. 4 is an exploded perspective view of portions of FIG. 1.
Figure 5:
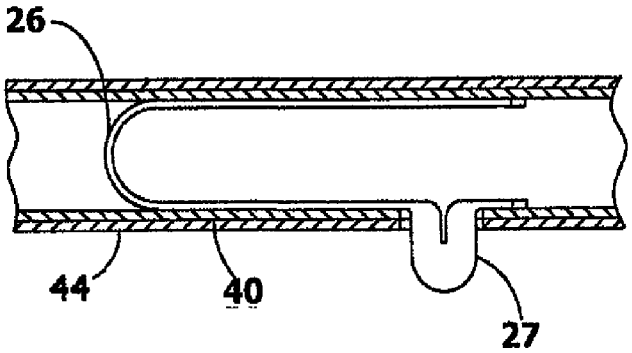
FIG. 5 is a sectional view of the fence taken along lines 5-5 of FIG. 1.
Figure 6:
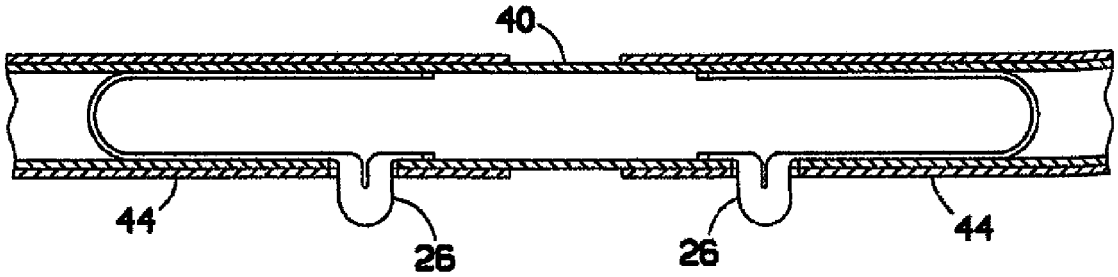
FIG. 6 is a sectional view of the fence taken along lines 6-6 of FIG. 1.
Figure 7:
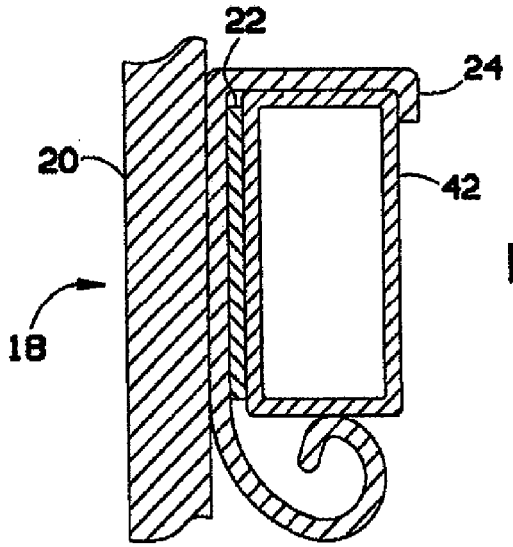
FIG. 7 is a sectional view of the fence taken along lines 7-7 of FIG. 1.
Figure 8:
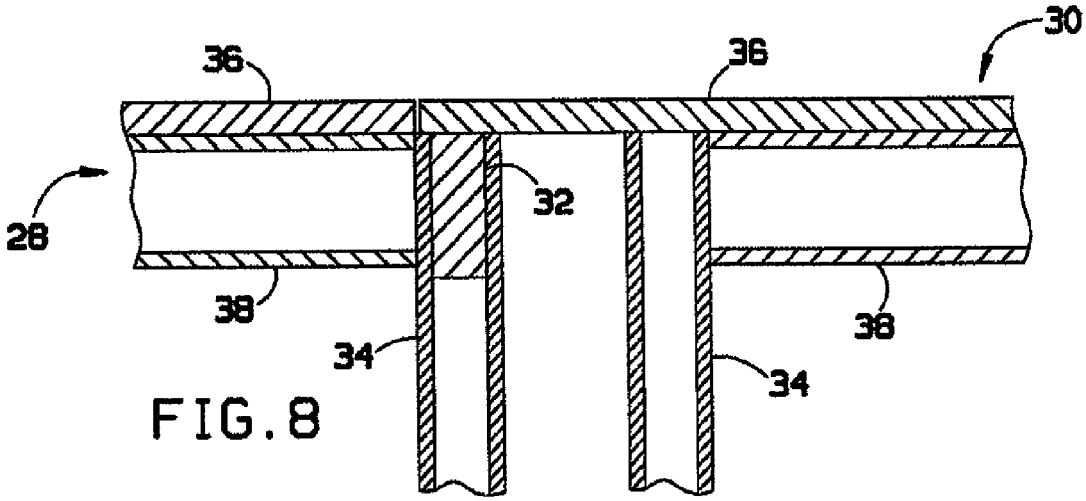
FIG. 8 is a sectional view of the fence taken along lines 8-8 of FIG. 1.

The top and bottom rails 42, 44 should be 47 inches×2 inches×1,0.65 inch rectangular tubes having ½-inch diameter hole 43 drilled in one of the 2-inch sides 4 inches from each end of the rails. Hole 43 seizes the button pin 27. Hook and loop squares 22 having the size of 1 inch×1 inch are affixed to the non-drilled side of the top and bottom rails 42, 44 about 8 inches apart to secure the slats 18 to the top and bottom rails. It is to be noted that only one portion of the hook/loop combination is shown in FIG. 4.

The footing includes a flat base 46 formed of a 24 inch long ¼ inch×2 inch flat metal plate having two rods 48 above and perpendicular in the center of the base one inch apart. The rods are 6 inches long hot rolled ¾-inch steel bar and are formed to removably fit into the second end of vertical members 34. Pickets 18 may include a wood slat 20 approximately 38 inches long and 4 inches wide with a Roman top at one end or other design of choice. One 2 inch plastic table clip 24 is glued to the wood slat 20 about 3 inches from the top and another one about 6 inches from the bottom, such that the clips may be clipped on the top and bottom rails 42, 44 over the hook and loop squares 22. It is to be understood that the post 28, 30 and the pickets 18 may be made larger to accommodate the customer's needs. In addition, different types of slats may be used, such as vinyl, wood, wrought iron, cedar slats or fence wire to give different looks other than the picket fence look, as shown. Instead of rectangular tubing, round tubing may be used.

Figure 9:
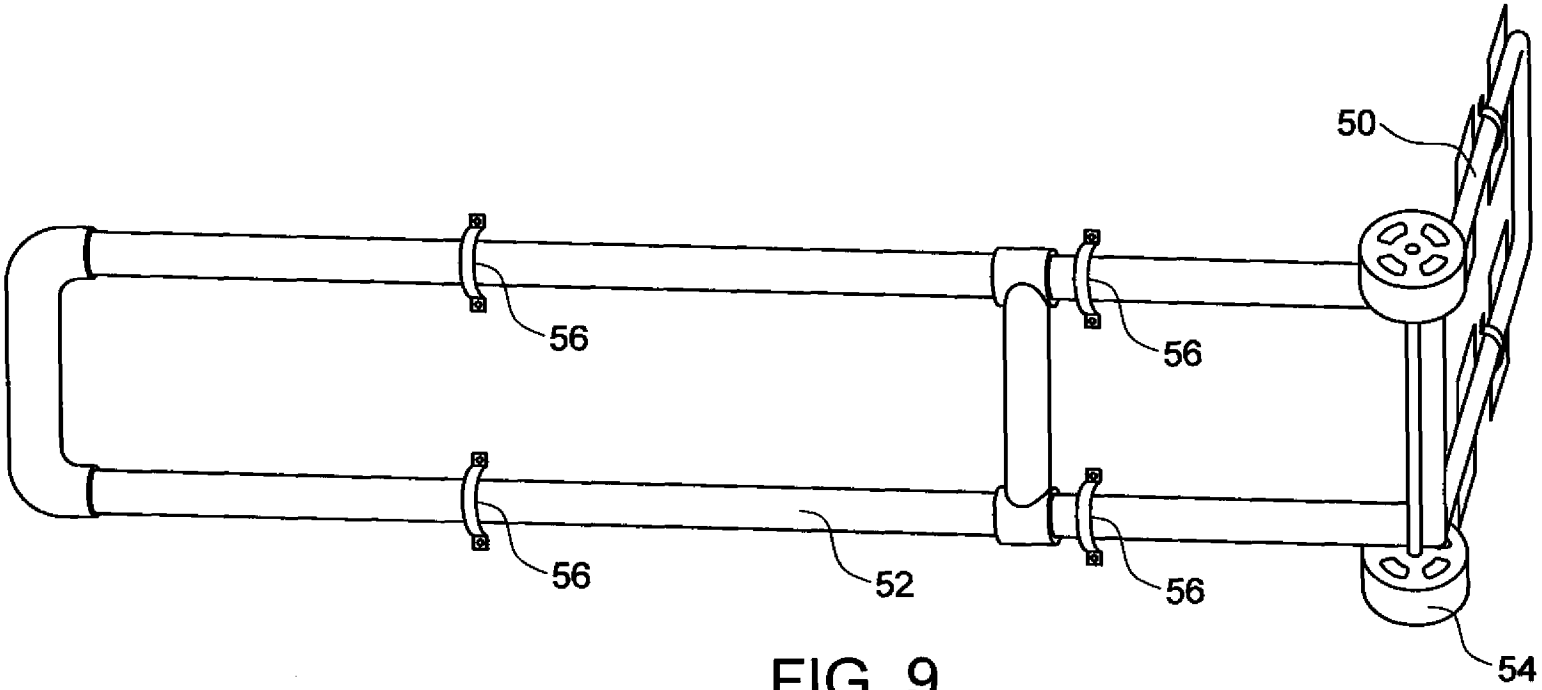
FIG. 9 is an isometric view of the portable cart for transporting the inventive fence.
Figure 10:
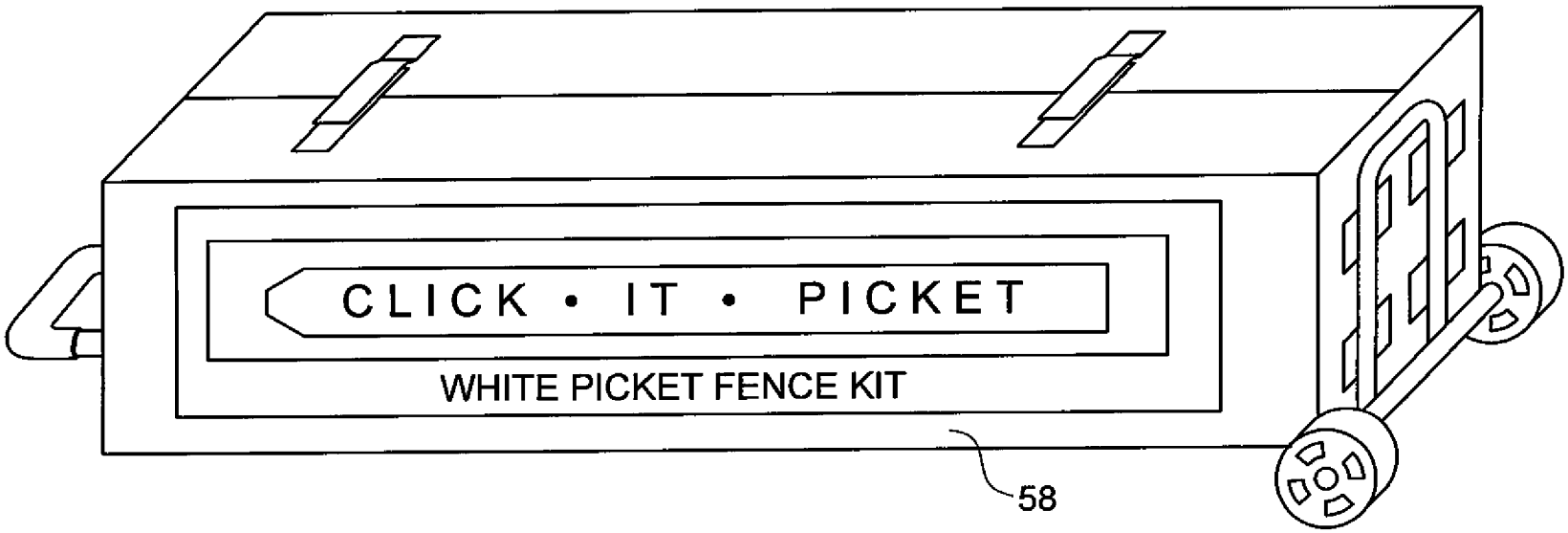
FIG. 10 is an isometric view of the portable cart which has attached thereto a container for containing the fence.

As seen in FIG. 9, a cart is shown having a horizontal platform 50 and a vertical handle or frame 52, and further including wheels 54, wherein said cart is designed to be secured to a container by straps 56, as shown in FIG. 10, to hold, transport and store a fencing section 10.

As best seen in FIG. 10, the handle or frame 52 extends above the container 58 and allows easy transport of the fence sections secured within the container.

The do-it-yourself fence kit may address the needs of the rental industry, such as party rentals, fence rental companies and wedding and event planners. It is too be understood that it may be modified into gates, railing or balusters and may be used to form dog kennels, chicken coops and the like.

Although a preferred embodiment has been disclosed for purposes of illustration, it should be understood that various changes and modifications and substitutions could be made in the preferred embodiment without departing from the spirit of the invention as defined by the claims which follow:

What is claimed is:

1. A combination fencing unit and container therefore, comprising:

a fencing unit which when assembled comprises:

a pair of tubular posts;

a pair of spaced horizontal members fixedly attached to each of the tubular posts prior to assembly of the fence unit, extending from the fence unit, the horizontal members each having a radial opening therethrough;

a pair of identical top and bottom rails, each rail including rail sections and an intermediate rail connector, with radial openings through the rail sections and rail connector, and spring biased tube clips with button pins disposed interiorly of each rail section and the rail connector in the vicinity of opposing ends of the rail connector, wherein the button pins pop through the radial openings in each rail and the rail connector for complete assembly thereof, and each spring biased clip and button pins disposed interiorly of the rail section and each horizontal member, wherein the button pins pop through the radial openings in said rail section and horizontal member to hold the rail section to the horizontal member;

picket slats and clips having spring biased upper and lower arm portions to enable placement of the slats on and removal of the slats from the top and bottom rails; and a pair of spaced footing members with elongated elements extending upwardly therefrom and received into the tubular posts;

wherein the combination further includes a portable, wheeled container assembly for storing and transporting the fencing unit when the fencing unit is in a dismantled condition.

2. The combination of claim 1, wherein the wheeled container assembly includes a wheeled cart and a container unit for the dismantled fencing unit.

3. The combination of claim 1, wherein the container is secured to the cart.

4. The combination of claim 3, wherein the securement is by straps.

5. The combination of claim 1, including a metal piece fixedly attached to a top side of an upper horizontal member such that the metal piece extends outwardly from one of the tubular posts and a connector pin which extends downwardly from a free end of the metal piece configured to join a tubular post from an adjacent fencing unit.

* * * * *